United States Patent [19]

Bayard

[11] Patent Number: 4,765,281

[45] Date of Patent: Aug. 23, 1988

[54] HEATING DEVICE

[75] Inventor: Bo Bayard, Täby, Sweden

[73] Assignee: Atlas Copco Aktiebolag, Stockholm, Sweden

[21] Appl. No.: 11,151

[22] Filed: Feb. 5, 1987

[30] Foreign Application Priority Data

Mar. 3, 1986 [SE] Sweden ..... 8600934

[51] Int. Cl.[4] ..... F02B 63/00

[52] U.S. Cl. ..... 123/2; 123/149 D; 431/264

[58] Field of Search ..... 123/149 D, 2, 142.5 R; 431/264, 265; 237/12.1; 126/110 B

[56] References Cited

U.S. PATENT DOCUMENTS

| | | | |
|---|---|---|---|
| 2,384,468 | 9/1945 | Holthouse | 126/110 B |
| 2,492,654 | 12/1949 | Richards | 126/110 B |
| 2,744,516 | 5/1956 | Hubbard | 126/110 B |

*Primary Examiner*—Ira S. Lazarus
*Assistant Examiner*—Peggy Neils
*Attorney, Agent, or Firm*—Eric Y. Munson

[57] ABSTRACT

Heating device comprising a combustion engine (11), a fan (13) and an oil burner (15) with oil pump (16). The combustion engine and the oil burner receive ignition pulses from two transistorized ignition coils (19, 21), both induced by a permanent magnet (18) on and rotatable with the engine flywheel (12).

3 Claims, 1 Drawing Sheet

HEATING DEVICE

The present invention relates to a heating device of the type which blows hot air into the space to be heated.

In a prior art heating device a combustion engine is used which drives a fan and an oil pump which provides an oil burner with oil. The combustion engine then has its own ignition system and the oil burner a separate ignition system comprising a transformer and connection to an electric network or if an electric network is not available to a motor generator.

The present invention, which is defined in the appended claim, aims at achieving a heating device of the above mentioned kind where the transformer becomes superfluous. Furthermore, there is no need to have access to an electric network or to a motor generator.

Figure 1:
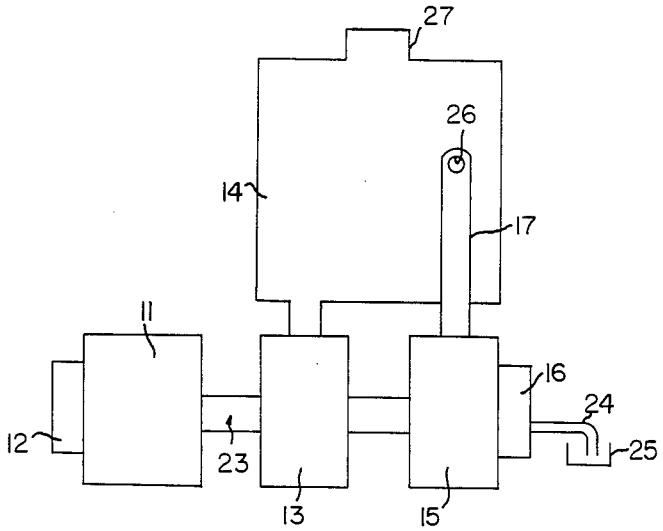
Figure 2:
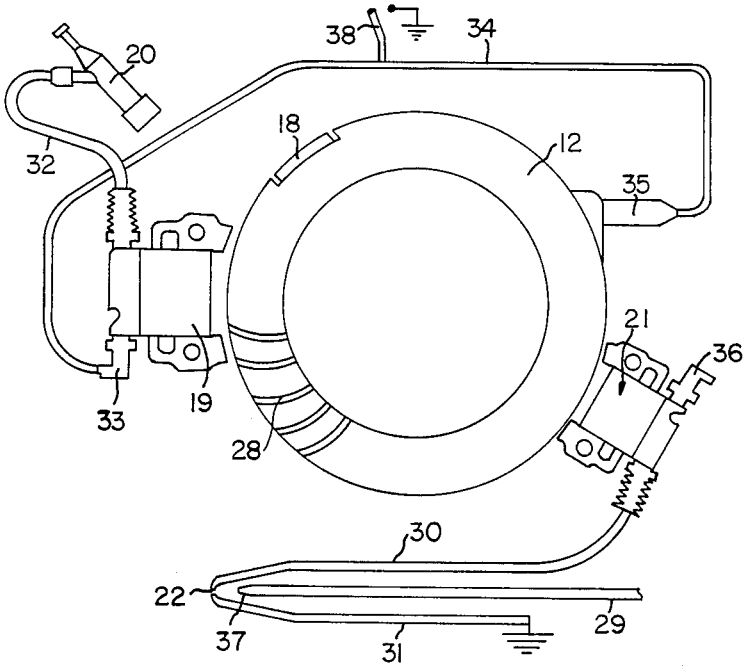

An embodiment of the invention is described below with reference to the accompanying drawing in which FIG. 1 schematically shows a heating device according to the invention. FIG. 2 shows schematically the ignition system.

The shown heating device comprises a combustion engine 11 provided with a flywheel 12 and an outgoing shaft 23. Shaft 23 drives a fan 13 and an oil pump 16. Oil pump 16 sucks oil through a tube 24 from a tank 25 and delivers the oil through a tube 29 to a nozzle 37 in an oil burner 15 where the oil is atomized.

Flywheel 12 is provided with means, in form of a magnet 18, for initiating an ignition pulse in each ignition coil 19, 21. The ignition coils are of normal, commercially available, type which comprise a sensing coil and semiconductors for voltage amplification and possibly pulse shaping. The unit 19 delivers ignition pulses via conductor 32 to spark plug 20 of the combustion engine. Unit 21 delivers ignition pulses via conductor 30 to a spark gap 22 where the atomized oil is ignited. Conductor 31 connects the spark gap 22 to common. Flywheel 12 is provided with fan blades 28 of which only a few are shown. Unit 19 is provided with a short circuit device 33 to which a conductor 34 and one or more sensing units 38, in form of bimetal springs, are connected between the normal stop button 35 and the short circuit device 33 on the ignition coil 19. Unit 38 can be arranged to sense overheating of for instance the heat exchanger in which case the short circuit device 33 short circuits the ignition coil 19 so that no ignition pulses reach the spark plug 20. Spark plug 21 can be short-circuited in a similar way by means of the short circuit device 36.

Fan 13 supplies fresh air to chamber 14 where the air is heated through heat exchanging contact with the outlet channel 17 of oil burner 15. Combustion gases from the oil burner are conducted away through an exhaust pipe 26. The heated air is conducted through the outlet 27 to a consumer which could be a tent or similar or another space which is to be heated.

What is claimed:

1. A heating device comprizing:

a combustion engine (11) provided with a flywheel (12) for the operation thereof;

supply means (13) driven by said engine (11) for supplying heating medium to a chamber (14) to be heated therein;

an oil burner (15) for heating said medium;

an oil pump (16) driven by said engine (11) for supplying oil to said oil burner (15), said burner (15) being provided with an outlet channel (17) extending into said chamber (14) in heat exchanging relationship with the medium therein; and a permanently magnetized area (18) on and rotatable with said flywheel (12) so as to alternately pass in sequence a first ignition coil and semiconductor unit (19) on said engine connected for delivering ignition pulses to a sparkplug (20) of said engine (11), and, subsequently, a second ignition coil and semiconductor unit (21) on said engine (11) for initiating ignition pulses;

said second ignition coil and semiconductor unit (21) being connected to a spark gap (22) in said oil burner (15) for igniting the oil delivered thereto by said oil pump (16).

2. A heating device according to claim 1, wherein said permanently magnetized area is provided by a magnet (18) fixedly connected to the rim of said flywheel (12).

3. A heating device according to claim 1, wherein said heating medium is air and said supply means is a fan (13) separate from said flywheel (12), said fan (13) supplying fresh air to said chamber (14).

* * * * *